US009293040B2

(12) United States Patent
Kwon et al.

(10) Patent No.: US 9,293,040 B2
(45) Date of Patent: Mar. 22, 2016

(54) DATA QUALITY ASSESSMENT AND REAL-TIME EVALUATION OF GPS PROBE DATA

(71) Applicant: ITERIS, INC., Santa Ana, CA (US)

(72) Inventors: Jaimyoung Kwon, Berkeley, CA (US); Karl F. Petty, Berkeley, CA (US); Alex A. Kurzhanskiy, Albany, CA (US); Andrew J. Moylan, Berkeley, CA (US)

(73) Assignee: ITERIS, INC., Santa Ana, CA (US)

( * ) Notice: Subject to any disclaimer, the term of this patent is extended or adjusted under 35 U.S.C. 154(b) by 0 days.

(21) Appl. No.: 14/321,759

(22) Filed: Jul. 1, 2014

(65) Prior Publication Data

US 2015/0006069 A1 Jan. 1, 2015

Related U.S. Application Data

(60) Provisional application No. 61/841,452, filed on Jul. 1, 2013.

(51) Int. Cl.

| | |
|---|---|
| ***G08G 1/01*** | (2006.01) |
| ***G08G 1/14*** | (2006.01) |
| ***G08G 1/133*** | (2006.01) |
| ***G08G 1/052*** | (2006.01) |

(52) U.S. Cl.

CPC ..... *G08G 1/052* (2013.01); *G08G 1/0112* (2013.01); *G08G 1/0133* (2013.01); *G08G 1/0141* (2013.01)

(58) Field of Classification Search

CPC ... G08G 1/052; G08G 1/0112; G08G 1/0133; G08G 1/0141

USPC ..... 701/119

See application file for complete search history.

(56) References Cited

U.S. PATENT DOCUMENTS

| | | | | |
|---|---|---|---|---|
| 7,835,858 | B2 * | 11/2010 | Smyth | G08G 1/0104 701/117 |
| 2006/0074544 | A1 * | 4/2006 | Morariu | B61L 27/0027 701/117 |
| 2008/0208441 | A1 * | 8/2008 | Cheung | C08G 1/096716 701/117 |

(Continued)

OTHER PUBLICATIONS

Herrera et al. "Evaluation of traffic data obtained via GPS-enabled mobile phones", Aug. 2009, 28 pages.*

(Continued)

*Primary Examiner* — Mussa A Shaawat
*Assistant Examiner* — Yazan A Soofi
(74) *Attorney, Agent, or Firm* — Lazaris IP

(57) ABSTRACT

Quality assessment of probe data collected from GPS systems is performed by a system and method of determining a value of data points provided by different vendors of such data. Incoming raw probe data is initially analyzed for removal of extraneous data points, and is then mapped to roadway links and smoothed out. The resulting output is processed to determine the coverage value of data provided by a given vendor and enable a comparison between different vendors. Such a model of probe data processing also enables an evaluation of a contribution of further vendors of raw probe data to an existing dataset. Additionally, a real-time performance evaluation of continually-ingested probe data includes building historical and data count profiles, and generating output data represented by a number of data points for a specific distance within a geo-box representing a geographical area, to project a value of raw probe data for a next incremental time period.

20 Claims, 5 Drawing Sheets

(56) References Cited

U.S. PATENT DOCUMENTS

2011/0288756 A1* 11/2011 Chapman ..... G08G 1/0104
701/118
2014/0159923 A1* 6/2014 Koodli ..... G08G 1/0112
340/905

OTHER PUBLICATIONS

Moukas et al., "Trafficopter A Distributed Collection Sysytem for Traffic Information", Jul. 1998, 11 pages.*

* cited by examiner

400

Telogis
TeleNav Filtered
TeleNav Full
Percent covered
Range (+/-) in meters
0
200
400
600
800
1000
2
4
6
8
10
12
14
16
18
410
420

DATA QUALITY ASSESSMENT AND REAL-TIME EVALUATION OF GPS PROBE DATA

CROSS-REFERENCE TO RELATED PATENT APPLICATIONS

This patent application claims priority to U.S. provisional application 61/841,452, filed on Jul. 1, 2013, the contents of which are incorporated in their entirety herein.

FIELD OF THE INVENTION

The present invention relates to analyzing GPS data. Specifically, the present invention relates to a system and method of assessing the relevancy of bulk GPS probe data, determining the contribution of additional probe data from different vendors, and performing real-time evaluations of the probe data for vertical commercial applications.

BACKGROUND OF THE INVENTION

Data generated by geographical position systems (GPS) is currently sold in bulk, by the number of data points per day or per month. Generally, this data may be packaged in different ways—for example, in the form of "raw" or unprocessed probe data points, or in the form of processed probe data that reflects traffic speed on a roadway network. Ingests of raw probe data include data points of which many will not be relevant to the purchaser, and there is no current methodology for evaluating how much data in a bulk dataset of raw probe data is pertinent from the collection of information provided by each vendor. Similarly, there is no existing framework in the existing art for determining the value of a data point in a dataset that can be used to comparatively evaluate different vendors.

Raw probe data is useful for extracting information about traffic conditions on roadways, such as for example vehicular speed. Once a subscription to bulk raw probe data from a set (N) of vendors is undertaken, however, there is no current methodology for determining how much further value each additional vendor (N+1) provides for improving the analysis of roadway conditions like traffic flow from speed. In other words, there is no known framework in existence that permits traffic engineers to judge whether the accuracy of data extracted from a GPS dataset can be improved by additional subscriptions to vended probe data.

Additionally, there is no current methodology for performing a real-time evaluation of raw probe data to enable a prediction of data quality and realize a distribution of value extracted from an analysis of the quality of data points in a dataset. Because of the large number of GPS devices in use today, a real-time tool for foreseeing future roadway conditions such as traffic flow from known data would have significant utility in the marketplace, and would enable monetization of the value embedded within datasets comprised of raw probe data.

BRIEF SUMMARY OF THE INVENTION

The present invention provides a system and method of determining quality of raw GPS probe data in a vended dataset. Data is usually provided by GPS firms on a subscription basis, and as noted herein, may be provided in either a raw or unprocessed form, or pre-processed so that traffic speed is already known. Regardless, the present invention provides a framework for assessment of the quality of data in a dataset to enable evaluation of the data points contained therein, resulting in a number of benefits and objectives as noted throughout this disclosure.

In one embodiment of the present invention, a system and method of assessing a value of traffic information in a set of GPS probe data is disclosed in which incoming raw probe data is initially analyzed to "clean-up" the dataset for removal of unnecessary information. The data is then mapped to roadway links, and smeared to fill in missing values that are an inherent characteristic of GPS datasets. The resulting output is then analyzed to determine the coverage value of data provided by a given vendor, and enable a comparison of a different vendors.

Another embodiment of the present invention involves evaluating a contribution of further vendors of probe data to an existing dataset. This embodiment seeks to determine how much additional value is added by subscribing to a dataset provided by a new vendor. Coverage surfaces are constructed for a full dataset that includes the new vendor, and for a dataset that excludes data provided by the new vendor. The coverage surface excluding the new vendor is subtracted from the first coverage surface to determine the added coverage surface. This added coverage surface is then used to calculate the value of data provided by the new vendor by spatially comparing the number of data points with those provided by other vendors across a common length with a geographical area.

Still another embodiment of the present invention provides a system and method for a real-time performance evaluation of continually-ingested probe data. Historical coverage profiles and data count profiles are built for each vendor, for each day of the week, for raw probe data ingested from a plurality of vendors on a periodic basis. These historical coverage profiles and the data count profiles are updated at specified time intervals, and an evaluation of probe data is performed for all of the vendors on a periodic basis to project a value of probe data for a next incremental time period, so that where the full dataset that includes data from all participating vendors for the time period is valued at a value X, values of contributing datasets are fractions of the value X, proportional to their area of coverage. This embodiment permits a real-time evaluation of probe data to project data quality on a forward-looking basis, and may be used to establish a database of vendors and a framework for monetizing data embedded in raw probe data, such as an auction-based trading platform. Yet another embodiment of the present invention therefore involves commercializing GPS probe data subjected to the above analyses to determine the quality and value of data in a dataset.

It is therefore one objective of the present invention to provide a framework for evaluating how much data in a bulk dataset of raw probe data provided by each vendor is pertinent for determining traffic information, such as speed. It is also an objective of the present invention to provide a framework for determining the value of a data point in a dataset that can be used to comparatively evaluate different vendors. Another objective is a framework for determining how much incremental value is provided by additional vendors for improving the assessment of roadway conditions like traffic flow. Still another objective is to provide a framework for real-time evaluation that can be used to predict traffic conditions and generate further revenue streams from processing of raw probe data.

Other objectives, embodiments, features and advantages of the present invention will become apparent from the following description of the embodiments, taken together with the accompanying figures, which illustrate, by way of example, the principles of the invention.

BRIEF DESCRIPTION OF THE SEVERAL VIEWS OF THE DRAWINGS

The accompanying drawings, which are incorporated in and constitute a part of this specification, illustrate several embodiments of the invention and together with the description, serve to explain the principles of the invention.

DETAILED DESCRIPTION OF THE INVENTION

In the following description of the present invention reference is made to the exemplary embodiments illustrating the principles of the present invention and how it is practiced. Other embodiments will be utilized to practice the present invention and structural and functional changes will be made thereto without departing from the scope of the present invention.

Figure 1:
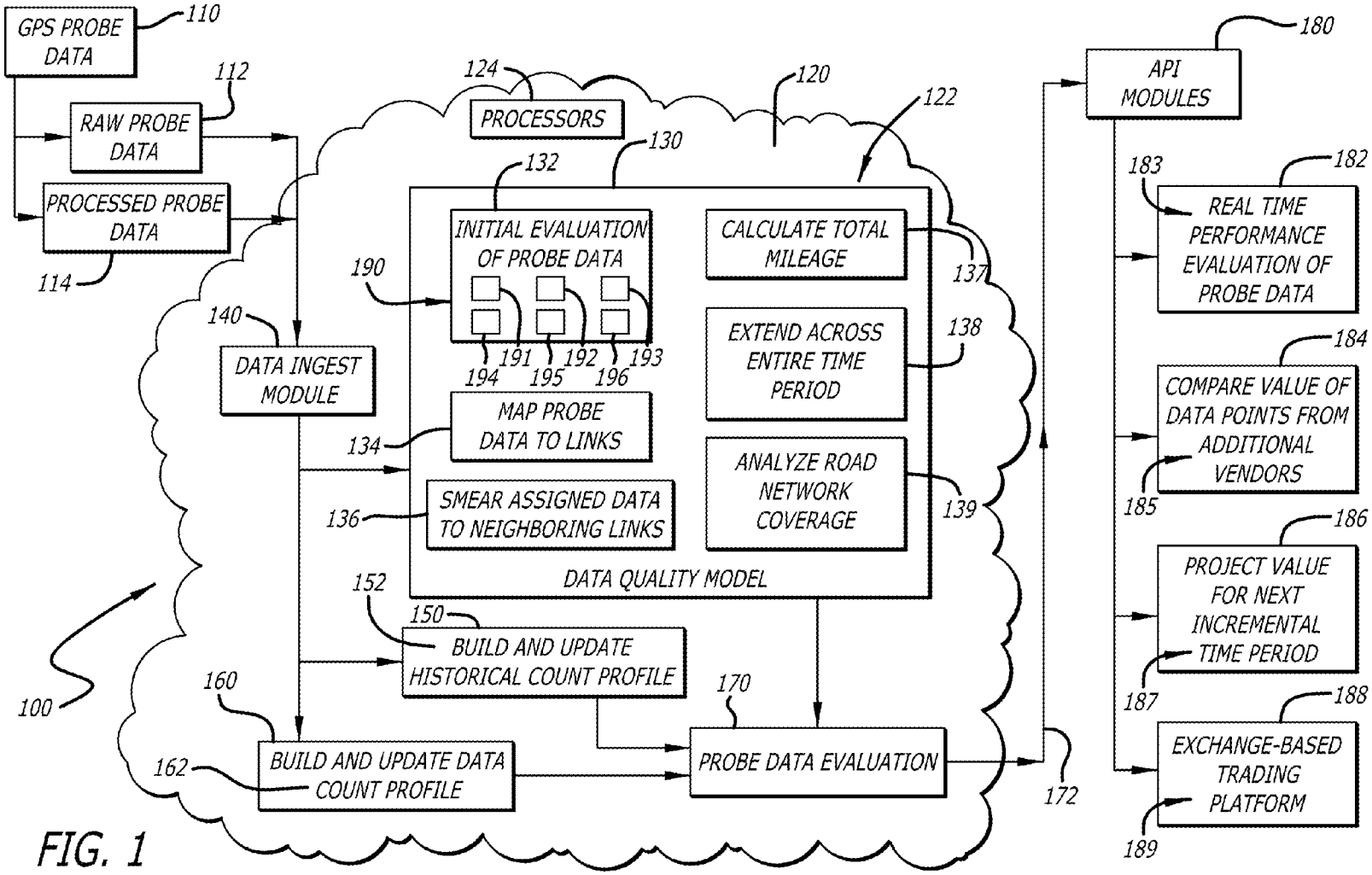
FIG. 1 is a block diagram of system components for a GPS data quality assessment and real-time evaluation tool according to the present invention.

The present invention discloses a GPS data quality assessment and real-time evaluation tool 100, as shown for example in FIG. 1. In the present invention, quality of data 110 collected from GPS systems in its "raw", or unprocessed, form 112 is assessed using several criteria. As noted above, raw probe data 112 is a collection of bulk data points in a GPS dataset, in contrast to probe data 114 that has been processed so as to be associated with traffic speed on a roadway network. The GPS data quality assessment and real-time evaluation tool 100 is configured to determine, in one aspect of the present invention, the real value of raw probe data 112 by applying one or more data processing functions to extract insight based on qualitative characteristics relative to these criteria.

One criteria for analyzing data quality pertains to the accuracy of raw probe data 112 and focuses on how collected data matches actual conditions. Another criteria is confidence, which asks how trustworthy the raw probe data 112 is for its utility, and another is delay, which seeks to determine how quickly the customer receives data once it has been collected and packaged by the vendor.

Consistency is another criteria upon which raw probe data 112 is evaluated. This seeks to determine whether speed readings are consistent between data points during a common trip (e.g., if speed from a given device is reported every second, then jitter is undesirable in the measurement.)

Other characteristics when assessing quality of raw probe data 112 include the sampling rate, which determines how much data can be ignored (e.g., with sampling rate 1 second, we can drop between 50% and 90% of data by retaining only every 5th or every 10th measurement) and device error (which looks at how large the share of bad data points is). Other criteria include an analysis of how large the portion of single point trips is, how large the portion of high-speed outliers (e.g. speed>100 mph) is, and how large the portion of zero-speed points is.

Temporal and spatial coverage of the raw GPS probe data 112 are also analyzed by the embodiments of the present invention disclosed herein. Breadth of spatial coverage is one characteristic, and looks at how wide the size of a geographical area is that is covered by raw probe data. Depth of spatial coverage is another issue, which looks at density for smaller geographical areas of interest. Time is also of interest, as consumers of raw probe data 112 are particularly interested in peak hours, such as in the morning and afternoon, during which congestion is mostly to occur, for a given geographical area.

The present invention provides a GPS data quality assessment and real-time evaluation tool 100 as noted above, which presents a system and method of assessing and evaluating the quality of raw probe data 112 for use in traffic data analytics. Raw probe data 112 is evaluated in the present invention using a process comprised of a number of steps as described herein in a data quality model 130. These steps are performed in a plurality of data processing functions, embodied in one or more modules 122 within a computing environment 120 that includes one or more processors 124, a plurality of software and hardware components, and a computer-readable storage medium operably coupled to the one or more processors 124 and having program instructions stored therein, the one or more processors 124 being operable to execute the program instructions to carry out the data quality model 130 and the other functions embodied in the one or more modules 122. One such module is a data ingest module 140, which is configured to ingest GPS data 110 (either raw 112 or processed 114) for the data quality model 130.

Another module is an initial evaluation module 132, which performs steps 190 comprising an initial evaluation 191 of raw probe data 112. The steps 90 performed by the initial evaluation module 132 begin with ascertaining a number of individual trips 192 represented by the raw probe data 112, which provides an upper bound on the number of individual probes within a given time interval. Once this is determined, the data quality model 130 of the GPS data quality assessment and real-time evaluation tool 100 retains only non-trivial trips, for example those containing more than one data point.

The number of individual trips is ascertained in step 192, for example, by looking at identifiers provided by vendors. Some vendors provide identifiers representative of individual devices, and from that information, the number of trips can be inferred. Others vendors provide session identifiers that change every 10 minutes, which means that a single device may switch session identifiers several times during a single trip. From individual session identifiers themselves, full trip information cannot be determined, but the present invention infers a trip from a trajectory that spans a single session.

Processing delay is then checked in the raw probe data 112 for an assessment of confidence 193. Specifically, this step 193 performs a processing delay analysis, which looks at the lag between the instant that data was read from the device used to collect it, and the moment it is ingested for processing in the data quality model 130. The confidence level of the measured data is then analyzed, such as a determination of the presence of specific parameters in the probe data received. For example, some vendors of probe data 110 provide a parameter called Horizontal Dilution of Precision (HDOP) which serves as a measure of confidence, since a high HDOP means high a presence of noise. HDOP specifies the additional multiplicative effect of navigation satellite geometry on positional measurement precision. HDOP measures the effect of geometry of satellites on positional error, and is roughly interpreted as a ratio of position error to range error. The relative position of the combined satellites determines the level of precision in each dimension of the GPS measurement. Basically, when visible navigation satellites are close together in the sky, the geometry is said to be weak and the DOP value is high; when far apart, the geometry is strong and the DOP value is low. Low HDOP, indicative of strong geometry, is ideal, since it reflects that positional measurements are precise enough for sensitive applications. Conversely, a high HDOP (indicative of weak geometry) is considered poor, as the higher the value, the less confidence exists that the device is correctly taking positional measurements.

The initial evaluation step 191 continues with a clean-up 194 of the raw probe data 112, first by removing data points with a HDOP of greater than a fixed value (for example, greater than 10), and then by removing data points reflective of a speed in excess of a certain value, such as for example 100 mph. The GPS data quality assessment and real-time evaluation tool 100 then also removes single-point trips and trips consisting of all zero-speed points. In an optional configuration, a sampling rate may also be reduced, by dropping extra data (the best sampling rate is 1/10 Hz).

Following these clean-up procedures, the initial evaluation module 132 conducts a rough and preliminary assessment of probe density to understand spatial and temporal coverage 195. First, a wide-area map (for example, a national map) is divided into smaller geographical groupings, or geo-boxes, and probe counts are computed for each geo-box by letting P be the number of data points per a given time interval in every geo-box. The total mileage of significant road links is then computed (e.g. road class 1 through 4), M, for every geo-box with a number of data points above a certain threshold (e.g. 1000). This mileage information is provided by map vendors (e.g. Navteq, OpenStreetMaps).

A resultant value from P divided by M represents an upper bound on the average number of data points per mile within a geo-box. Where the value of P/M is very low (or very high for M/1, this indicates no coverage for this geo-box in the given time interval. For this exercise, a recommended time interval is one day (and in the case of real-time applications as discussed further herein—the last hour). Geo-boxes where coverage exists can be sorted by the P/M value in descending order.

Figure 2:
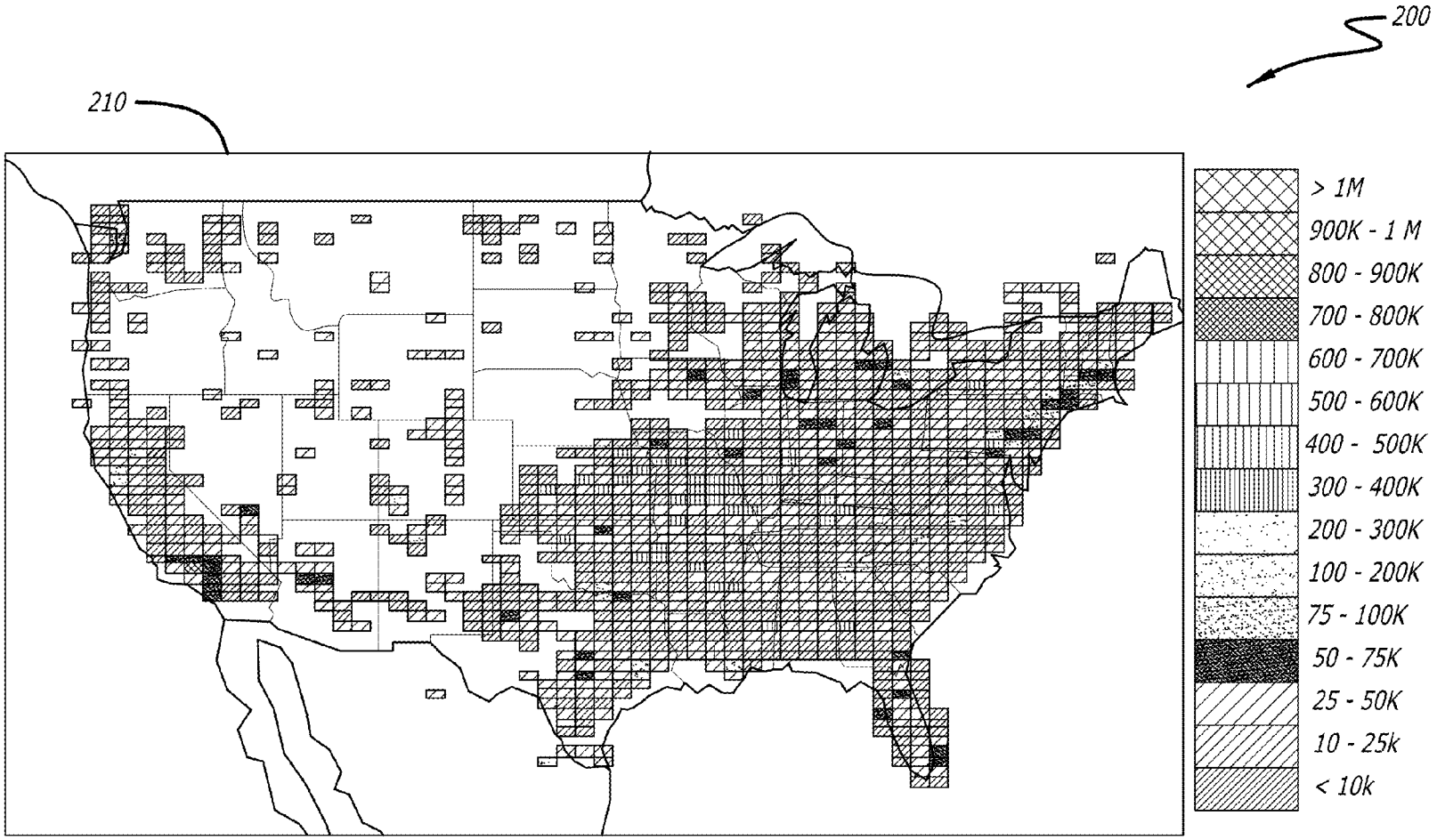
FIG. 2 is a graphical representation of exemplary daily probe data coverage of United States data provides by one vendor.

FIG. 2 is an exemplary graphical representation 200 of coverage of daily probe data 110 in the United States, obtained from a single vendor following the steps of the initial evaluation 132 described above. The color of each geo-box 210 represents the number of probe counts. Similarly, the color can represent P/M (or M/P). Uncovered areas having zero, or an insignificant amount, of probe data 110 can be ignored.

The last step performed by the initial evaluation module 132 of raw probe data 112 is a consideration of bias 196. Consider as an example that some probe data vendors sell data generated by delivery and service vehicles, and these types of vehicles normally follow a stop-and-go moving pattern, while mostly operating on arterials. While this does not necessarily accurately reflect overall traffic conditions, freeway traffic is generally unaffected. Raw probe data 112 from other vendors includes trips being made by pedestrians and bicyclists. One method of accounting for such bias is by examining anecdotal evidence through inspection of selected individual trips, and removing biased data based on these inspections. Another approach examines patterns in vended datasets with known tendencies to include biased data, to gain an understanding of those patterns so that algorithms can be applied to filter data that results in skewed traffic speed information, such as data generated by pedestrians.

The foregoing steps, as noted, are part an initial evaluation phase that serves to prepare probe data 112 for further evaluation that comprises matching and smearing 136 (sometimes also known as "smoothing") that allows the smeared probe data 112 to be mapped 134, or "snapped," to neighboring road links. This mapped data may then be processed to determine and fill-in missing values in datasets.

Once the above steps in module 132 have been performed to initially evaluate the raw probe data 112, the data quality model 130 then proceeds by analyzing probe data 112 inside individual geo-boxes, where sufficient data are present. In a first step in analyzing the raw probe data inside individual geo-boxes, the present invention attempts to match or map cleaned-up GPS data points 134 to roadway segments, or links, provided by a map vendor. This can be done by simply snapping GPS data points to the nearest links, or by invoking algorithms that are more sophisticated and accurate. From this mapping/matching procedure 134, each data point gets an assigned direct road link probability, and an offset within that link. The present invention retains only those data points assigned with a probability greater than a set value, such as for example 0.5, and those assigned to the links of a road class in a specified range (e.g. 1 through 4). All other data is discarded.

After data points with probabilities greater than the set value as above are retained, the data quality model 130 looks at every link to which a data point within a specific time interval is assigned. Each such road link is marked as covered during this time interval. The time interval is also a configurable value, similar to the assigned probability value above.

The data quality model 130 then proceeds with smearing 134 the raw probe data 112 for covered road links during the time interval from above, using any one of a number of known and existing methods. This extends speed readings from the links with assigned data point(s) to neighbors within a specified range (e.g. 250 meters). One method for doing this is disclosed in U.S. Non-Provisional patent application Ser. No. 14/321,754 (titled Traffic Speed Estimation Using Temporal and Spatial Smoothing of GPS Speed Data), the contents of which are incorporated by reference herein in their entirety. In this method, initial data in a GPS dataset is used to build a rescaled speed profile that permits a free-flowing speed estimation. This free-flowing speed estimate is then compressed together with the profile build to links, resulting in a model that can be applied in real-time to fill in the missing values in an input data set by applying a snapping procedure to the GPS data, and then applying a spatial smoothing procedure to the known speed data using the rescaled speed data to arrive at sufficient estimates for the missing values. Regardless of the method utilized, neighboring links that fall within the range of data points are marked as covered so that assigned data has been smeared to neighboring links in step 136. The present invention then calculates the total mileage 137 of covered links by summing their lengths, which is identified by the variable C. Now, 100*C/M represents the percentage of the transportation network covered by raw probe data 112 for the specific time interval, within a given smoothing range.

Figure 3:
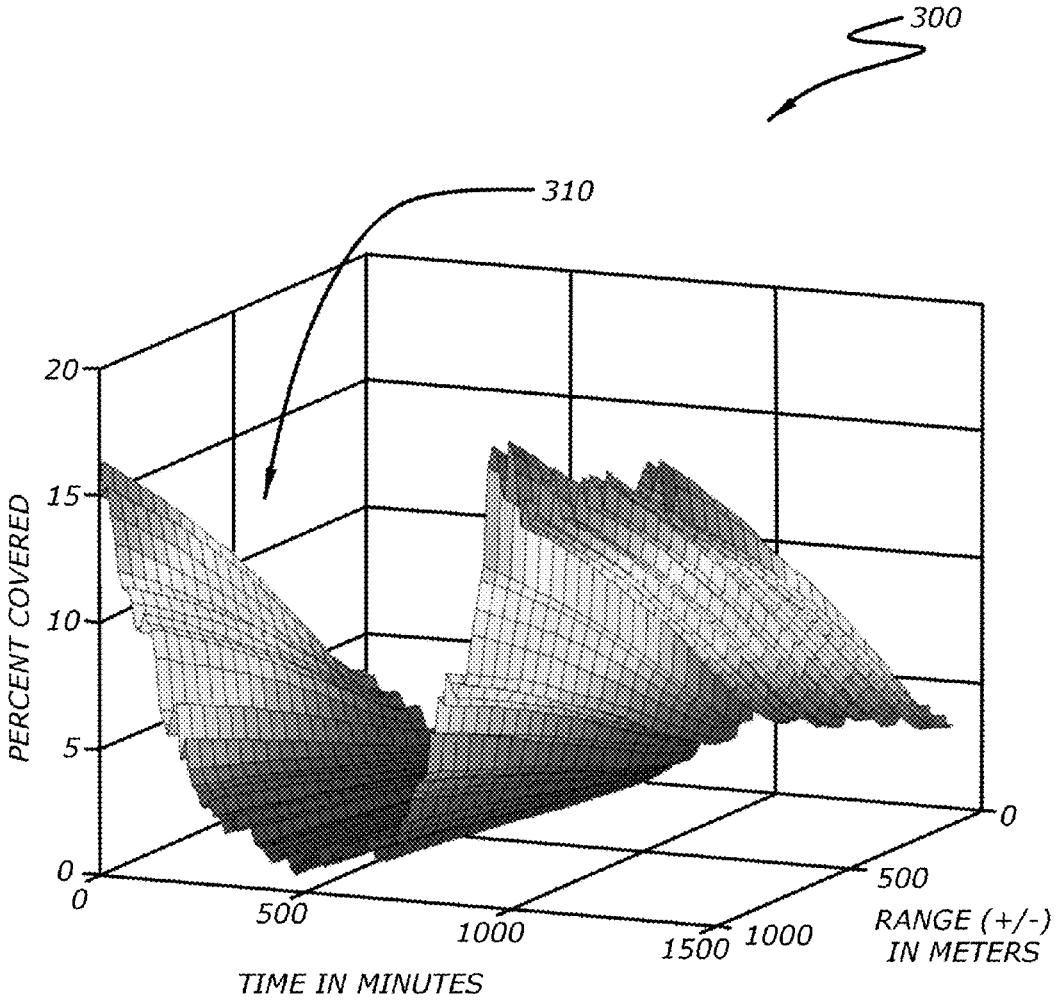
FIG. 3 is an exemplary graphical representation of a percentage of a road network covered by raw probe data, depending on the time of day and the smoothing/smearing range.

The immediately-preceding steps of examining every link to which a data point within given a time interval is assigned (the mapping/matching 134) and smoothing 136 the raw probe data 112 for covered road links to identify neighboring links falling within the range of data points is then repeated, and the present invention calculates total mileage 137 of covered links with 10-minute step intervals to extend across an entire time period 138, such as for an entire 24-hour day, using different range values. This provides the coverage surface 310, which is shown in the graphical representation 300 of percentage of a road network covered by raw probe data 112 (the coverage surface 310), depending on the time of day and the smoothing/smearing range, as shown for example in FIG. 3.

Figure 4:
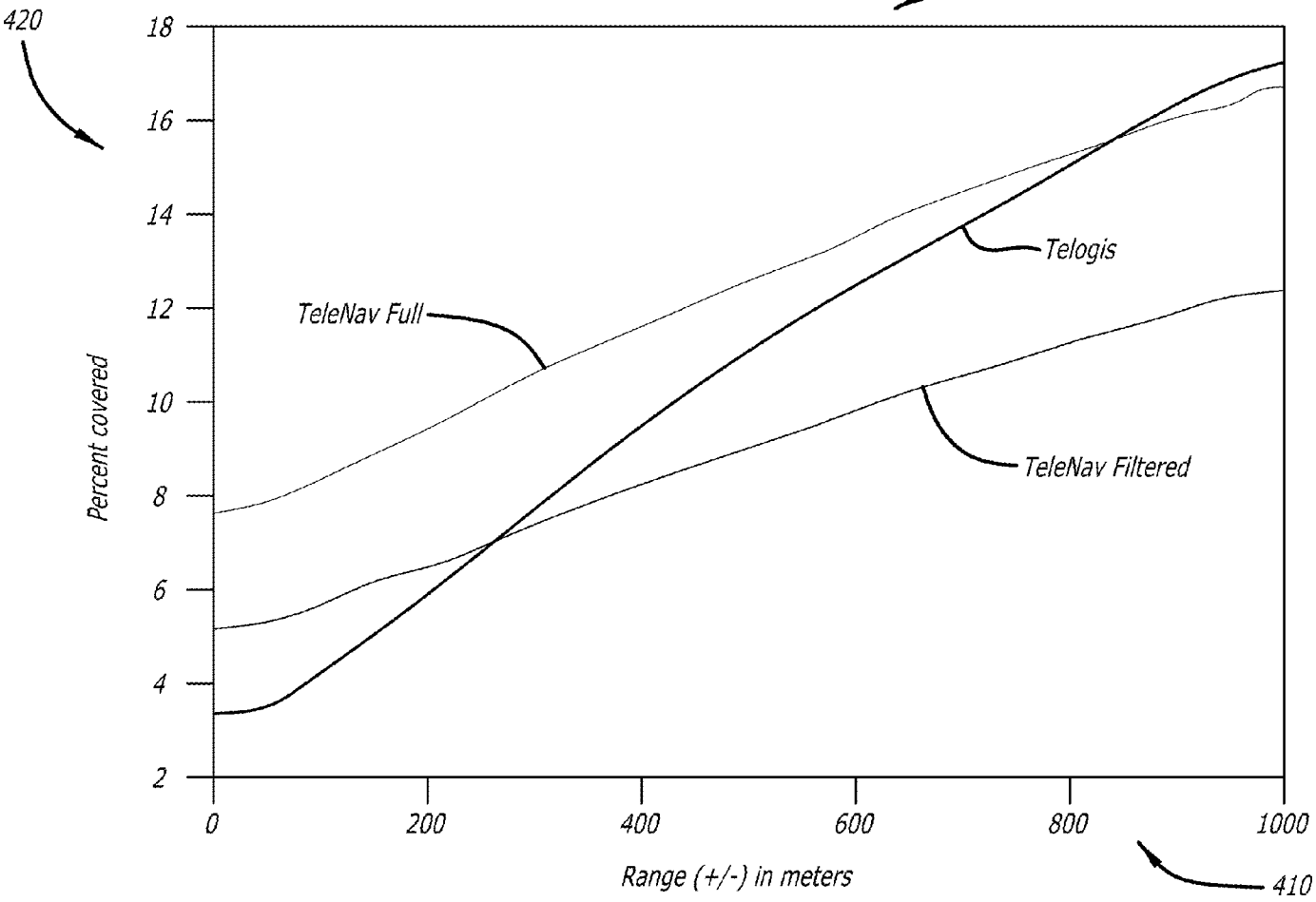
FIG. 4 is a graphical representation of exemplary coverage of Bay Area road network for given 10-minute interval provided by different vendors of GPS data.

FIG. 4 is an exemplary graphical representation 400 of a coverage of a Bay Area road network depending on smearing range for given 10-minute interval provided by different vendors. By analyzing these coverage surfaces 310 for data from different vendors for the same or similar days (e.g. same days of the week), the present invention is capable of inferring which vendor's data has the better (or, more comprehensive) spatial coverage—as seen in FIG. 4, for a smearing range of 250 meters or less, vendor #2 has better coverage than vendor #1. This changes however with range increases, indicating that data from vendor #1 is more scattered. This means that increasing the data quantity by vendor #1 will yield a larger spatial coverage increase than the same data quantity increase by vendor #2. Curves displayed in FIG. 4 are obtained by cutting the corresponding coverage surfaces 310 (FIG. 3) parallel to the Range axis 410 and Percent Covered axis 420 at the given time instant. The GPS data quality assessment and evaluation tool 100 therefore includes, in one embodiment, a method of comparing vended probe data 110 in terms of the comprehensiveness of its capacity for spatial coverage of a transportation network.

Figure 5:
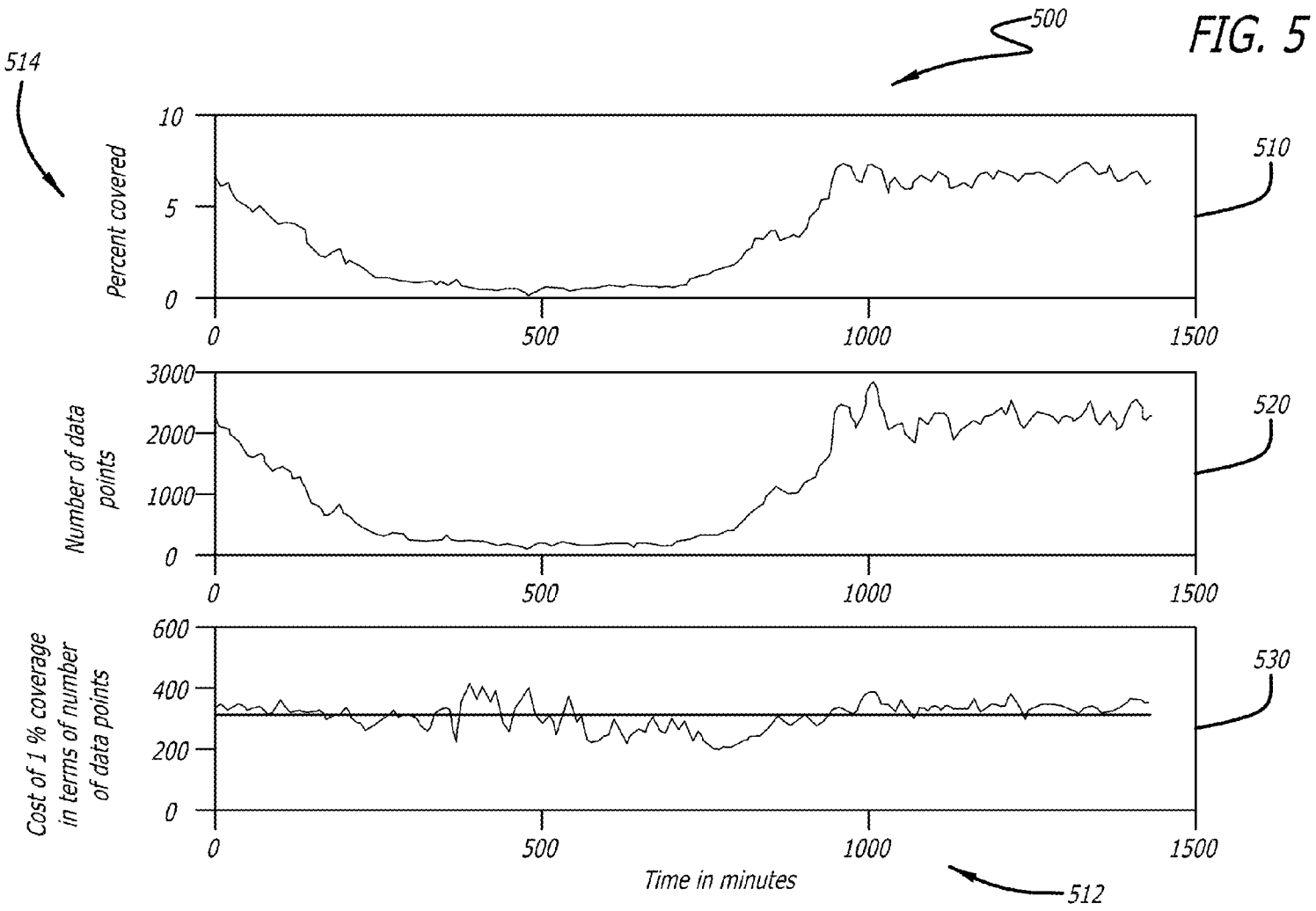
FIG. 5 is an exemplary graphical representation of data value in terms of road network coverage.

Following these initial evaluation steps, it remains to analyze road network coverage 139 together with the number of data points within the given geo-box 210 to determine the qualitative value of data points for comparing different vendors. Referring to FIG. 5, which is a graphical representation 500 of value of data in terms of road network coverage (in this case, 5 data points cover 1 mile of road network), the top plot 510 is obtained as a cut of the coverage surface 310 of FIG. 3, parallel to the Time 512 and Percent covered 514 axes at a given range value (e.g. 250 meters). The middle plot 520 in FIG. 5 displays the number of data points inside the geo-box during the day. The GPS data quality assessment and evaluation tool 100 divides the time series in the middle plot by the time series in the top plot and arrive at the bottom plot 530—which is the number of data points covering 1% of the road network within the given geo-box. This can be immediately translated into the number of data points covering one (1) mile of roads inside the geo-box.

From these translated data points the GPS data quality assessment and evaluation tool 100 is capable of providing an indicator of data quality. For example, if a first vendor covers 1 mile with 5 data points, while 70 data points from a second vendor covers the same distance, it means that a data point from the first vendor is 14 times more valuable than a data point from the second vendor, in terms of road network coverage.

The result of the full analysis for the value of points of raw probe data 112 in the example above is reflected in the map shown in FIG. 2, where each colored box represents the cost of one-mile coverage in terms of data points. This analysis for the value of raw probe data points 112 may be fine-tuned as needed. For example, it can be configured to focus on roads only within a certain classification, such as freeways or major surface thoroughfares, and within in a specified geographical area. Also, the value of raw probe data 112 may be assigned for coverage of specific roadways of interest. Additionally, time constraints may be imposed (e.g. only for peak or rush hours).

After performing the analysis described above, GPS data quality assessment and evaluation tool 100 in one embodiment may be configured to generate, as output data 172, metrics that permit an overall assessment of a particular set of raw probe data 112. This may be in the form of a tabular summary certificate, which can be visualized by a user evaluating raw probe data 112 on for example a graphical user interface.

Such a tabular display of information relating to the qualitative criteria may include information such as bias, confidence level, sampling rate, processing delay, etc. The preceding steps therefore are configured to generate output data 172 in an output file that provides detailed information on the qualitative characteristics in raw probe data 112 discussed above. This information may be packaged together with processed probe data 114 when monetizing information extracted therefrom, such as in the auction-based trading platform embodiment discussed further herein.

In another embodiment of the present invention, the additional value 185 provided by new raw probe data 112 from further vendors is computed as follows. The steps of map matching 134 and smearing 136 in the data quality model 130 discussed above are performed on road networks including the new raw probe data 112, where links with probe data (either directly or through smearing) are marked as covered a priori (these links are already associated with and covered by existing vendor probe data). Some additional links are covered as a result of this process, and a new coverage surface is obtained as discussed with regard to FIG. 3 above. The present invention then subtracts the existing coverage surface 310 from the new coverage surface, and uses the result to perform calculations as described above to find the marginal value of new raw probe data 112.

In this embodiment, the present invention evaluates the contribution of a new vendor j where the existing dataset includes N probe data vendors. The evaluation may be performed by first building a coverage surface 310 (as in FIG. 3) considering the full dataset, and then building a second coverage surface for the dataset excluding data points from vendor j. The evaluation proceeds by subtracting the second coverage surface from the first coverage surface 310, with the resulting surface representing the coverage added by vendor j. The present invention uses this resulting coverage surface to calculate the value 185 of data for vendor j by analyzing the road network coverage together with the number of raw probe data points within a geo-box, as described above.

In this manner, the present invention may also be configured to periodically re-evaluate each raw probe data vendor, so that vendors whose probe data provides only very little additional contribution may be discarded. The time for this periodic re-evaluation may be customized, as may be parameters for deciding what constitutes a threshold for determining that a vendor's additional contribution is acceptable or unacceptable.

Relative to still another embodiment, it follows that the GPS data quality assessment and evaluation tool 100 may be configured to perform a real-time evaluation 160 of raw probe data 112 as that data is provided by vendors, and generate, as possible output data 172, a real-time performance evaluation, and a projected value of raw probe data 112 over a next incremental time period. Referring to FIG. 1, the GPS data quality assessment and evaluation tool 100 also includes modules to build and update historical count profiles 152 in module 150, and to build and update data count profiles 162 in module 160. In this embodiment, raw probe data 112 is ingested from N vendors as input data to the data quality model 130 described herein, on a continual or periodic basis. Historical count profiles 152 and data count profiles 162 are built as in FIG. 5 for each vendor, for each day of week. These may be medians of one or more time series from FIG. 4. These profiles 152 and 162 are updated on a regular basis, for example daily or weekly.

An evaluation by probe data evaluation module 170 of raw probe data 112 for all the vendors is performed on a periodic basis, for example hourly. Where such an hourly evaluation occurs, the result for the most recent hour together with its historical profile 152 is modeled to project the value of probe data 112 for the next hour. If the full dataset (the dataset that includes data from all participating vendors) for the hour is valued at X, values of additional, incoming contributing datasets are fractions of X, proportional to their area of coverage. The GPS data quality assessment and evaluation tool 100 further contemplates that roads of a certain classification, or certain links forming specified routes, may be assigned a greater weight and thus be more valuable in terms of coverage. The GPS data quality assessment and evaluation tool 100 is therefore capable of modeling probe datasets as they are continually ingested, and capable of predicting near-term coverage of incoming datasets based on coverage profiles constructed in real time on ingested data.

The above method of projecting future value of probe data 110 is just one of many ways of distributing the value extracted from raw probe data 112, and it is to be noted that the present invention shall not be limited by any one such way of value distribution. Regardless, in this embodiment, the GPS data quality assessment and evaluation tool 100 models existing raw probe data 112 to obtain an impression of its coverage over a specific period in real time, and then applies mathematical formulas to predict the coverage of further data over a similar, next-in-time period.

The probe data evaluation module 170 of the GPS data quality assessment and evaluation tool produces output data 172 that is processed to interpret a qualitative value of data points that have processed by the data quality model 130 and other modules within the plurality of modules 122. Output data 172 may be distributed from the probe data evaluation module 170 to one or more application programming interface (API) modules 180 that are configured to develop downstream uses of the output data 172, such as for example module 182 that converts the output data 172 into real-time performance evaluations 183 of the raw probe data 112. Another module 184 in the API modules 180, as noted above, enables a comparison of value 185 from data points in raw probe data 112 ingested from additional vendors. Still another module 186 may be configured to project a value 187 of raw probe data 112 for a next incremental time period. Yet another module 188 may be configured to provide output data 172 for an exchange-based, online trading platform 189 as discussed further herein.

In yet another embodiment of the present invention discloses a system and method of auctioning real-time traffic data over a specific period of time. Where the GPS data quality assessment and evaluation tool 100 is able to understand the quality of traffic data coming from N raw probe data vendors and model a prediction of the data quality of incoming traffic for the next relevant period of time (whether it be hourly, daily, weekly, monthly, or some other period of time) a trading platform 189 for raw probe data vendors can be established for items such as traffic data for a geographic region (for example, the San Francisco Bay Area) on a specific data (DD/MM/YYYY) in a time interval between, for example, 5 am and 9 pm local time. Such an embodiment therefore establishes one exemplar use for output data 172 from the GPS data quality assessment and evaluation tool 100 discussed above.

Suppose traffic data is sold for an upcoming time period:

[hour(s)/day(s)/week(s)/month]

and there are K customers. All customers submit their bids b_1, b_2, . . . , b_K by a given deadline. Assume here that bids are already sorted in a descending order: b_1≥b_2≥ . . . b_K. The auction-based trading platform 188 may incorporate a rule in which all participants whose bid was higher than or equal to the dataset price S win (where a win=obtaining access to the dataset), while the others lose (where lose=do not obtain access to the dataset). The price S for the dataset is chosen as $$S=\text{argmax}_{bk} kb_k,$$

where bk is the k-th highest bid. So, if maximum profit is achieved with the k-th bid, bk, it means that the first k participants get the dataset at price S=b_k, and the others do not obtain access to the data. The profit resulting from this sale is kS, and it is divided between the raw probe data vendors contributing to the dataset proportionally to the percent of significant roads covered. Where a separate entity provides an electronic trading platform 189 incorporating one or more features of the present invention, a fee can be deducted from the profit kS to compensate the separate entity.

This embodiment further contemplates that there are several ways of composing data bundles for sale. Exemplary approaches are two extremes: in a first extreme, datasets from individual vendors are sold separately. The other extreme approach is to create dataset bundles, where for example an identifier such as GOLD designates a full dataset, SILVER designates 75% of the full dataset (letting a random 25% of data points to be dropped), BRONZE designates 50% of the full dataset (letting a random 50% of data points to be dropped), SMALL designates 10% of the full dataset (10% sample of the full dataset), and TINY designates 1% of the full dataset (1% sample of the full dataset). Any possible combination between these two extremes is also contemplated, such as for example where only datasets for those vendors agreeing to be part of such an auction-based trading platform are included, and further, where the sale is to be made for specific commercial purposes, such as for example animation of traffic flow via media outlets or device-based applications. A further approach contemplated involves bundling datasets based on time period covered, so that customers, or buyers, are given the opportunity to bid on datasets for the next hour(s), day(s), week(s), or month(s).

Also, is it to be evident that any identifier may be used, and therefore not limited to any such notation herein. Other features of such auctions may also permit vendors to set lower limits on price, below which they may opt-out from selling their data.

Returning to GOLD/SILVER/BRONZE/SMALL/TINY exemplary approach, such an auction may comprise several rounds that proceed with auctioning certain bundles of data first, such as the GOLD bundle proceeding before all others. Losers automatically participate in the second round with the same bids for the SILVER bundle, so that winners of the second round purchase the datasets with the SILVER designation, and so forth—the losers move on to the third round where the BRONZE bundle is sold, etc. The auction ends when either all the dataset bundles are sold, or there are no more losers. One alternative mode of participation occurs when losers do not enter the next round automatically with the same bids, but instead have a choice of continuing or quitting. A further alternative mode may permit losers to submit new bids for every new round of the auction. Still another alternative may provide a hybrid approach in which the dataset bundles that cannot be sorted by rank are sold independently.

The systems and methods of the present invention may be implemented in many different computing environments 120. For example, they may be implemented in conjunction with a special purpose computer, a programmed microprocessor or microcontroller and peripheral integrated circuit element(s), an ASIC or other integrated circuit, a digital signal processor, electronic or logic circuitry such as discrete element circuit, a programmable logic device or gate array such as a PLD, PLA, FPGA, PAL, and any comparable means. In general, any means of implementing the methodology illustrated herein can be used to implement the various aspects of the present invention. Exemplary hardware that can be used for the present invention includes computers, handheld devices, telephones (e.g., cellular, Internet enabled, digital, analog, hybrids, and others), and other such hardware. Some of these devices include processors (e.g., a single or multiple microprocessors), memory, nonvolatile storage, input devices, and output devices. Furthermore, alternative software implementations including, but not limited to, distributed processing, parallel processing, or virtual machine processing can also be configured to perform the methods described herein.

The systems and methods of the present invention may also be partially implemented in software that can be stored on a storage medium, executed on programmed general-purpose computer with the cooperation of a controller and memory, a special purpose computer, a microprocessor, or the like. In these instances, the systems and methods of this invention can be implemented as a program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

Additionally, the data processing functions disclosed herein may be performed by one or more program instructions stored in or executed by such memory, and further may be performed by one or more modules configured to carry out those program instructions. Modules are intended to refer to any known or later developed hardware, software, firmware, artificial intelligence, fuzzy logic, expert system or combination of hardware and software that is capable of performing the data processing functionality described herein.

The foregoing descriptions of embodiments of the present invention have been presented for the purposes of illustration and description. It is not intended to be exhaustive or to limit the invention to the precise forms disclosed. Accordingly, many alterations, modifications and variations are possible in light of the above teachings, may be made by those having ordinary skill in the art without departing from the spirit and scope of the invention. It is therefore intended that the scope of the invention be limited not by this detailed description. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

The invention claimed is:

1. A computerized method of assessing a value of traffic speed information in a set of incoming GPS probe data, comprising:

extracting GPS information and one or more parameters from incoming GPS probe data using one or more GPS components configured to receive and process the incoming GPS probe data, the one or more parameters including a measure of confidence of positional measurement precision in the GPS information for determining spatial and temporal coverage on a road network;

performing an initial evaluation of the incoming GPS probe data to filter unneeded data points and conduct a preliminary assessment of probe coverage relative to a geographical grouping of roadway links; and modeling the incoming GPS probe data relative to the geographical grouping of roadway links to determine a road network coverage, within a computing environment comprised of hardware and software components that include at least one processor specifically configured to evaluate speed data in the incoming GPS probe data, by:

mapping the GPS probe data to match with the roadway links so that data points comprising the incoming GPS probe data are assigned directly to the roadway links, smearing the GPS probe data by extending speed readings from the roadway links with assigned data points to neighboring roadway links within a given range, summing lengths of the roadway links and neighboring roadway links to calculate a total mileage of all roadway links covered by the GPS probe data, extending the assigned data points across a specified time period using different ranges to determine the road network coverage, and determining a qualitative value of the assigned data points by translating a percentage of assigned data points in the road network coverage into an amount of the assigned data points covering a specified amount of miles inside the geographical grouping of roadway links.

2. The method of claim 1, further comprising assigning an offset to each data point mapped to the roadway links, and a probability qualifier to each data point based on an assessed coverage of the data point to the roadway link to which it is assigned.

3. The method of claim 1, further comprising discarding data points that cannot be mapped to match a roadway link.

4. The method of claim 3, further comprising discarding data points with a probability qualifier less than a specified value.

5. The method of claim 1, further comprising comparing different coverage surfaces for assigned GPS probe data from different vendors for the same or similar days to determine a spatial coverage provided by each vendor across the geographical groupings.

6. The method of claim 1, further comprising applying additional restrictions to compare the different coverage surfaces for GPS probe data from the different vendors, the additional restrictions relating to at least one of links only of a certain classification and specific periods of time.

7. The method of claim 1, further comprising generating an output data file comprising a summary of data analytics performed on the GPS probe data for each vendor.

8. A computerized method of real-time performance evaluation of raw probe data, comprising:

ingesting raw probe data from a plurality of vendors on at least a periodic basis;

extracting GPS information and one or more parameters from the raw probe data using one or more GPS components configured to receive and process the raw probe data, the one or more parameters including a measure of confidence of positional measurement precision in the GPS information for determining spatial and temporal coverage on a road network;

modeling the raw probe data within a computing environment comprised of hardware and software components that include at least one processor configured to assess a quality of the raw probe data and evaluate a real-time performance of the raw probe data, by processing the raw probe data to filter unneeded data points and conduct a preliminary assessment of probe coverage relative to a geographical grouping of roadway links, mapping the raw probe data to match with the geographical grouping of roadway links so that data points are assigned directly to the roadway links, smearing the assigned raw probe data by extending speed readings from the roadway links with assigned data points to neighboring roadway links within a given range, building a historical coverage profile and a data count profile for each vendor in the plurality of vendors, for each day of a week, updating the historical coverage profile and the data count profile at specified time intervals; and generating output data represented by a number of data points for a specific distance within a geographical area, and compiling the historical coverage profile with the output data for a most recent time period to project a value of probe data for a next incremental time period.

9. The method of claim 8, wherein the modeling the raw probe data further comprises constructing a first coverage surface for a set of raw probe data that includes data points for a vendor to be analyzed, and constructing a second coverage surface for a set of raw probe data that excludes data points from the vendor to be analyzed, and subtracting the second coverage surface from the first coverage, wherein the resultant coverage surface represents a coverage added by the vendor to be analyzed.

10. The method of claim 9, wherein the modeling the raw probe data further comprises calculating a value added by the vendor to be analyzed by spatially analyzing the resultant coverage surface to determine a number of data points representative of a specific distance within a geographical area.

11. The method of claim 10, wherein the modeling the raw probe data further comprises comparing the number of data points representative of a specific distance within the geographical area from the spatial analysis of the resultant coverage surface to a value of data points in one or more sets of raw probe data provided by other vendors.

12. The method of claim 11, wherein the modeling the raw probe data further comprises summing lengths of the roadway links and the neighboring roadway links to calculate a total mileage of all roadway links covered by the raw probe data.

13. The method of claim 12, wherein the modeling the raw probe data further comprises extending the assigned data points across a specified time period using different ranges to determine a road network coverage.

14. The method of claim 13, wherein the modeling the raw probe data further comprises determining a qualitative value of the assigned data points by translating a percentage of assigned data points in the road network coverage into an amount of the assigned data points covering a specified amount of miles inside the geographical grouping of roadway links.

15. A computerized system comprising:

a plurality of input data including raw probe data from a plurality of vendors on at least a periodic basis, the plurality of input data including GPS information and one or more parameters extracted from the raw probe data using one or more GPS components configured to receive and process the raw probe data, the one or more parameters including a measure of confidence of positional measurement precision in the GPS information for determining spatial and temporal coverage on a road network;

a plurality of data processing modules, executed by at least one computer processor within a computing environment, and configured to execute a data quality model to assess a quality of the raw probe data and evaluate a real-time performance of the raw probe data, the plurality of data processing modules including an initial evaluation computer memory module configured to process the raw probe data to filter unneeded data points and conduct a preliminary assessment of probe coverage relative to a geographical grouping of roadway links, a mapping computer memory module configured to match the raw probe data with the geographical grouping of roadway links so that data points are assigned directly to the roadway links, a smearing computer memory module configured to smooth the assigned raw probe data by extending speed readings from the roadway links with assigned data points to neighboring roadway links within a given range, a road network coverage analysis computer memory module configured to sum lengths of the roadway links and the neighboring roadway links to calculate a total mileage of all roadway links covered by the raw probe data, extend the assigned data points across a specified time period using different ranges to determine a road network coverage, and determine a qualitative value of the assigned data points by translating a percentage of assigned data points in the road network coverage into an amount of the assigned data points covering a specified amount of miles inside the geographical grouping of roadway links; and a probe data evaluation computer memory module configured to generate output data representative of the qualitative value of the assigned data points for distribution to one or more application programming modules to interpret the qualitative value of the assigned data points.

16. The system of claim 15, further comprising a data ingest computer memory module configured to receive the raw probe data from a plurality of vendors on at least a periodic basis.

17. The system of claim 15, further comprising a profile computer memory module configured to build a historical coverage profile for each vendor in the plurality of vendors for each day of a week and update at specified time intervals, and to build a data count profile for each vendor in the plurality of vendors, for each day of a week, and update the data count profile at the specified time intervals.

18. The system of claim 15, wherein the probe data evaluation computer memory module constructs a first coverage surface for a set of raw probe data that includes data points for a vendor to be analyzed, and constructs a second coverage surface for a set of raw probe data that excludes data points from the vendor to be analyzed, and subtracts the second coverage surface from the first coverage to generate a resultant coverage surface representing a coverage added by the vendor to be analyzed.

19. The method of claim 18, wherein the probe data evaluation computer memory module calculates a value added by the vendor to be analyzed by spatially analyzing the resultant coverage surface to determine a number of data points representative of a specific distance within the geographical grouping.

20. The method of claim 18, wherein the probe data evaluation computer memory module compares the number of data points representative of a specific distance within the geographical grouping from the spatial analysis of the resultant coverage surface to a value of data points in one or more sets of raw probe data provided by other vendors.

* * * * *